United States Patent [19]

Nakato et al.

[11] Patent Number: 4,673,024

[45] Date of Patent: Jun. 16, 1987

[54] CONTINUOUS CASTING APPARATUS FOR THE PRODUCTION OF CAST SHEETS

[75] Inventors: Hakaru Nakato; Tsutomu Nozaki; Katsuo Kinoshita; Yasuhiro Habu; Hiroaki Ohnuma; Shigeru Ohmiya, all of Chiba; Tomoaki Kimura, Hitachi, all of Japan

[73] Assignees: Kawasaki Steel Corporation, Kobe; Hitachi Ltd, Tokyo, both of Japan

[21] Appl. No.: 711,463

[22] PCT Filed: Jun. 29, 1984

[86] PCT No.: PCT/JP84/00339

§ 371 Date: Feb. 28, 1985

§ 102(e) Date: Feb. 28, 1985

[87] PCT Pub. No.: WO85/00125

PCT Pub. Date: Jan. 17, 1985

[30] Foreign Application Priority Data

Jun. 29, 1983 [JP] Japan ..... 58-116028

[51] Int. Cl.[4] ..... B22D 11/06

[52] U.S. Cl. ..... 164/431; 164/481

[58] Field of Search ..... 164/431, 432, 481

[56] References Cited

U.S. PATENT DOCUMENTS 4,582,114 4/1986 Saito et al. ..... 164/432

FOREIGN PATENT DOCUMENTS 59-189044 10/1984 Japan ..... 164/431

*Primary Examiner*—Kuang Y. Lin

*Attorney, Agent, or Firm*—Balogh, Kramer, Dvorak, Genova & Traub

[57] ABSTRACT

A belt-converging type continuous casting apparatus for the continuous production of sheet bar-like cast sheet, wherein a casting space is defined by a combination of a pair of metal belts for supporting broad side planes of the cast sheet arranged opposite to each other with circulatedly moving, and a pair of tapered fixed-type side plates for supporting narrow-side planes of the cast sheet each disposed between the metal belts in intimate contact therewith, and is characterized in that the shape of the side plate is designed so as to satisfy the following relations:

$d = 5\text{–}300$ mm, $D \geqq 60$ mm, $D/d \leqq 16$, $\theta \leqq 30°$ $\theta = \tan^{-1}(D - d/H$ to thereby prevent the occurrence of defects in the side planes of the cast sheet, while the metal belt is selected so as to satisfy the following relations:

$Sy \geqq 10{,}500\ t/Dr$, $0.4 \leqq t \leqq 2.5$, wherein Dr is a diameter of a guide roll (mm), to thereby prevent the deterioration of cast sheet quality and the casting accident accompanied with the deformation of the belt.

12 Claims, 14 Drawing Figures

CONTINUOUS CASTING APPARATUS FOR THE PRODUCTION OF CAST SHEETS

TECHNICAL FIELD

This invention relates to a technique for directly producing a cast sheet (steel sheet) of not more than 50 mm in thickness from molten metal, particularly molten steel without a rolling step, which proposes a belt converging type continuous casting apparatus for the production of such cast sheets comprising a combination of a pair of metal belts and a pair of tapered side plates.

BACKGROUND ART

In a field of producing steel plates, it has recently been attempted to continuously carry out casting and rolling for the purpose of energy-saving, increase of yield, labor-saving, stock-saving and improvement of quality.

In a general method of producing cast sheets using the conventional continuous casting process, cast slabs of about 150–300 mm in thickness are produced from molten steel by means of a continuous casting machine and then subjected to hot-rolling and cold-rolling to produce thin steel sheet of about 0.5–2 mm in thickness. This method is excellent in the production yield, labor-saving and energy-saving as compared with a method of obtaining a cast slab from an ingot through blooming. However, when the casting rate is increased to not less than 2.0 m/min in the usual continuous casting machine, not only the smooth casting becomes difficult but also the surface and inner defects of the cast sheet increase, so that it is very difficult to connect the continuous casting machine to the rolling mills at a continuously operating state. Therefore, even when using the continuous casting process, in order to obtain a thin steel sheet, it is required that the slab is subjected to a rough rolling and a finish rolling after it is reheated at a uniform temperature.

If the cast sheets of not more than 30 mm in thickness can directly be produced from molten steel according to the continuous casting, it is possible to omit some procedures from the rough rolling step for obtaining thin steel sheets. Moreover, if thin steel sheets of several mm in thickness can directly be casted from molten steel, the rolling step can considerably be simplified, so much more it is possible to reduce an investment cost and a processing cost.

Under the above situations, there have been made various attempts for directly producing cast steel sheets for thin steel plates from molten steel. For instance, there are a technique described in Japanese Patent laid-open No. 54-61,036, a technique described in Japanese Patent laid-open No. 54-139,835 and the like, but they have not yet been attained to industrial scale. In these techniques, it is particularly difficult to make a broad cast sheet.

FIG. 1 is a schematic view illustrating an embodiment of the apparatus in which such attempts are more improved. This apparatus comprises a pair of endless metal belts 1, 1' arranged opposite to each other and supported by guide rolls 2, 2', 3, 3' and 4, 4' so as to allow their circulation while keeping a gap for holding casting molten metal over a constant distance, a pair of side plates (not shown) for narrowside planes of a casting space pinched between the metal belts 1, 1' and located near the both side edges of the metal belts, metal pads 5, 5' arranged behind the opposed portions of the metal belts, and cooling fluid paths (not shown) provided inside of the metal pads for cooling and supporting molten steel through the metal belts by filmy cooling fluid flows formed by flowing a cooling fluid between the metal belts 1, 1' and the metal pads 5, 5', from nozzles of the paths opening at the pad surfaces side the belts, whereby molten metal 7 is poured into a casting space defined by the metal belts 1, 1' and the side plates from a pouring nozzle 6 and cooled and solidified along the surfaces of the metal belts and the side plates to obtain a cast sheet 8.

However, in the construction as shown in FIG. 1, it is demanded that the size in thickness direction of the molten steel flowpath in the pouring nozzle 6 for supplying the molten steel into the casting space must be small such as several mm to several tens mm and also the thickness of the refractory at the top of the pouring nozzle 6 must be thinned, so that there are such fatal drawbacks that molten steel is solidified in the pouring nozzle 6 to cause the clogging, and the refractory is eroded so as not to endure a long-term continuous service.

As the improved technique for solving the above drawbacks, there have been proposed a combination of casting wheels and belts as disclosed in Japanese Patent laid-open No. 57-32,852 and an apparatus as shown in FIG. 2. In the illustrated continuous casting apparatus, metal belts 1, 1', side plates 9, 9' and rolls 10, 10' and 11, 11' are arranged so that as the casting space defined by a pair of the opposed metal belts 1, 1' and a pair of the opposed side plates 9, 9' advances downward in the moving direction of the metal belts, the thickness of the resulting cast sheet is reduced from a thickness larger than a given thickness up to the given thickness to thereby define a downwardly tapered molten steel holding portion **12*a* and a subsequent molten steel solidifying portion 12*b*** having a constant thickness corresponding to the given thickness of the cast sheet.

Therefore, according to this continuous casting apparatus, as shown in FIG. 3, the molten steel 14 poured into the molten steel holding portion **12*a* through a pouring nozzle 13 forms a solidification shell 15 from its surfaces mainly contacting with the metal belts 1, 1', which is led into the molten steel solidifying portion 12*b* while the thickness t is gradually convegred during the downward movement with rowing and regulated to the desired thickness through the rolls 11, 11'. Then, in this molten steel solidifying portion, as shown in FIG. 4, the solidification shell 15 grows to complete the solidification at the outlet of the lower end of the solidifying portion, which is then drawn out in the form of cast sheet 8**.

As mentioned above, the continuous casting apparatus as shown in FIG. 2 is constructed so as to gradually reduce the thickness of the poured molten steel in the downwardly tapered or funnel-like molten steel holding portion **12*a*, so that it refers to as a belt converging type continuous casting apparatus. In this case, the size in thickness direction at the upper end part of the molten steel holding portion can be made large, so that the problem caused by the use of the thin pouring nozzle 7 as shown in FIG. 1 and also the lower end part of the pouring nozzle 13 can be immersed in the molten steel 14** to pour the molten steel at a non-oxidation state.

However, as mentioned above, in the belt converging type continuous casting apparatus as shown in FIG. 2, it is required to converge the unsolidified cast sheet formed by enveloping the unsolidified molten steel 14 with the solidification shell 15 in the thickness direction at the molten steel holding portion 12*a*. For this purpose, the converging rolls 11, 11' are arranged in a region changing from the tapered molten steel holding portion 12*a* to the molten steel solidifying portion 12*b* of constant thickness so as to apply a converging forces to the unsolidified cast sheet by the rolls 11, 11' through the metal belts 1, 1'. Accordingly, there are caused not only a problem that the unsolidified cast sheet formed by enveloping the unsolidified molten steel 14 with the solidification shell 15 is bulged through the converging force forcedly applied by the converging rolls to cause the breaking but also a problem that deep wrinkle-like defect and cracking are produced in the side surface of the resulting cast sheet.

As seen from the above apparatus, the guide rolls 2, 2', 3, 3' and 4, 4' for supporting the metal belts 1, 1' are usually used to have a diameter of 200–800 mm, while in the metal belts 1, 1' are used steel materials for general structure having a thickness of 0.4–3.0 mm.

However, since such metal belts 1, 1' are used under such a very severe condition that one surface of the metal belt comes into contact with the molten steel, while the other surface comes into contact with filmy cooling water flow from the water cooling pads 5, 5', there are the following various problems. That is, the metal belts 1, 1' are deformed into a wavy form in the widthwise direction. Therefore, the contacting state between the metal belts 1, 1' and the side plates becomes poor and consequently the molten steel penetrates into the generated gap to form fins and the surface of the cast sheet is led to indicate uneven wave form. Moreover, the sliding contact portions between the surfaces of the metal belts 1, 1' and the edges of the side plates are easily injured to promote the aforementioned deformation and fin formation and the considerably shorten the lifetime of the belt, which has caused an obstruction in a direct connection to a rolling equipment.

Furthermore, the metal belt has been endlessly joined by a butt TIG welding. In this case, however, the thermal deformation of the weld zone is large, so that the poor shape of the belt as mentioned above is caused and also cracking is apt to occur in the weld zone, particularly the thermally affected zone, occasionally resulting in the breaking of the belt.

Additionally, the above metal belt has the following problem. That is, as understood from the above, the side plates 9, 9' for the narrow-side planes of the illustrated continuous casting apparatus must be constructed so that by heating the side plates during the casting, particularly at the beginning of the casting, the formation of the solidification shell 15 along the side plate is made later than that of the other (broad-side) solidification shell formed along the side of the metal belts 1, 1' and therefore the rate of growing the thickness of the solidification shell becomes slower. This reason is based on the fact that since a considerable converging is required for casting a cast sheet of, for example, about 30 mm in thickness, if the formation of the solidification shell along the side plates 9, 9' is equal to or faster than that along the broad-side metal belts 1, 1', the cast sheet suffers a compression at the lower part of the converted casting space to generate cast wrinkles thereon and a drawing resistance becomes large and in extreme case the drawing can not be performed.

From the above, the inventors have already proposed apparatuses as disclosed in Japanese Patent laid-open No. 58-32,551 and Japanese Patent laid-open No. 58-32,552 prior to the filing of the invention, wherein it is attempted to slowly form the solidification shell at that portion of molten steel which contacts with the side plate for narrow-side plane by heating the side plates 9, 9' through heaters embedded therein while the inner surface of the side plate is made of refractory, or by radiating a flame of a gas burner to a gap defined between the side plate 9, 9' and a partition plate vertically arranged inside the side plate and spaced therefrom prior to the beginning of the casting.

However, the above prior arts have such a drawback that the surfaces of the metal belts 1, 1' are oxidized to reduce their lifetimes due to the heating of the side plates 9, 9'. This tendency is more remarkable since thinner metal belts are used as the metal belts 1, 1' in view of the cooling effect.

Moreover, such a problem has been found that in case of the above casters, the lubrication between the cast sheet (solidification shell) and the inner surface of the belt is insufficient to cause a seizing as compared with the ordinary continuous casting in which a mold is lubricated with powder by applying an oscillation.

It is, therefore, an object of the invention to overcome the aforementioned various drawbacks I5 involved in the known belt converting type continuous casting apparatus for the production of cast sheets: that is to say, Firstly, the shape of the side plates is optimizedly designed so as to prevent the occurrence of defects generated on the side surface of the cast sheet and make the drawing resistance as small as possible to hardly produce the narrow-side solidification shell in the molten steel holding portion;

Secondly, the metal belt is designed to have a long-term life without causing a reject quality of the cast sheet and an accident of casting due to deformation of the metal belt;

Thirdly, the metal belt is designed to be suitable for producing cast sheets having excellent antioxidant properties and lubricating properties and hence an improved surface form.

SUMMARY OF INVENTION

According to the invention, there is provided in a continuous casting apparatus of a belt converging type for the production of cast sheets comprising a combination of a pair of metal belts for supporting broad-side planes of the cast sheet arranged opposite to each other with circulatedly moving and a pair of tapered fixed-type side plates for supporting narrowside planes of the cast sheet each disposed between the metal belts in intimate contact therewith, the improvement wherein the side plate has such a shape that a width 2D at molten metal level of the side plate, a width 2d and a converging angle $\theta$ at lower position corresponding to the cast sheet thickness of the same side plate satisfy the following requirements:

$d = 5\text{–}300$ mm $D \geqq 60$ mm $D/d \leqq 16$ $\theta \leqq 30°[\theta = \tan^{-1}(D-d)/H$ (where, H is a vertical distance from the molten metal level to the upper end of the portion of constant width 2d)].

In addition to the aforementioned shape of the side plate, the metal belt is used to have an yield strength Sy satisfying the following relations to a thickness t of the best and a diameter Dr of a guide roll:

$Sy \geqq 10{,}500\ t/Dr$, $0.4 \leqq t \leqq 2.5$, wherein

Sy: yield strength ($kgf/mm^2$)

Dr: diameter of the guide roll (mm)

t: thickness of the belt (mm)

Moreover, that portion of the metal belt which contacts with motlen metal is covered with a lubricant having an antioxidant function.

By the use of the above side plate and metal belt are solved the subjects of the invention described in the above first to third points.

BRIEF DESCRIPTION OF DRAWING

FIG. 3 is a transverse section view taken along line IV—IV of FIG. 2;

BEST MODE OF CARRYING OUT THE INVENTION

Hereinafter, the detailed construction of the invention will be explained with reference to the accompanying drawings, firstly the side plate being examined.

Figure 1:
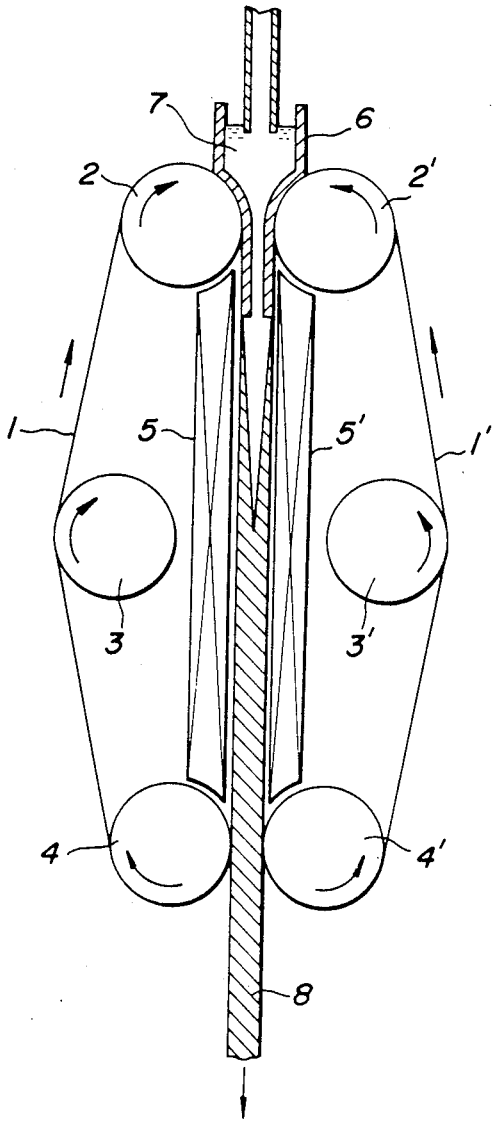
FIGS. 1 and 2 are schematically longitudinal section views in the casting portion of the conventional continuous casting apparatus for the production of cast sheets, respectively.
Figure 2:
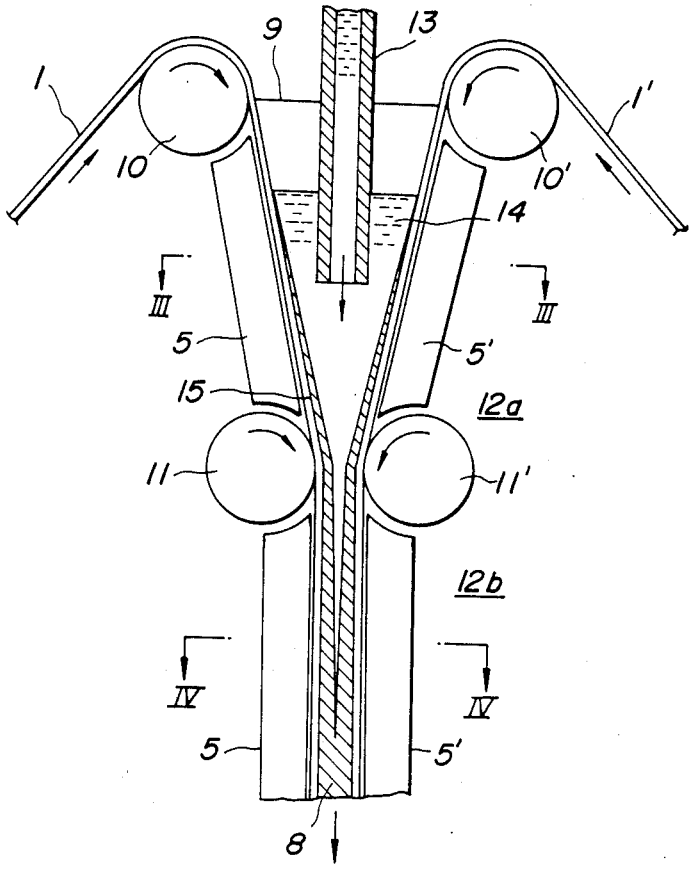
Figure 3:
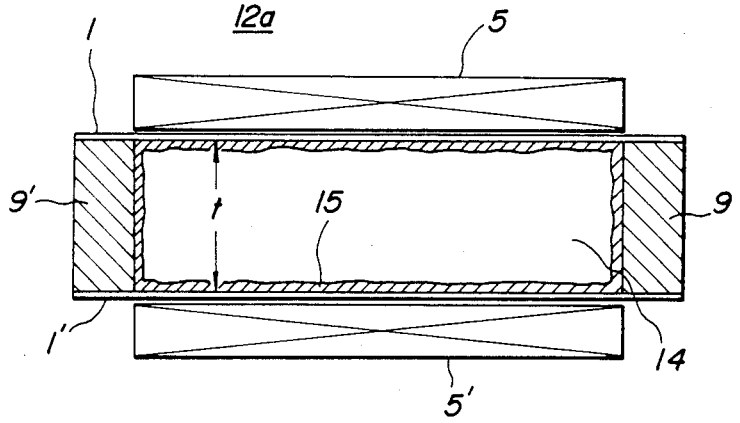
FIG. 3 is a transverse section view taken along line III—III of FIG. 2.
Figure 4:
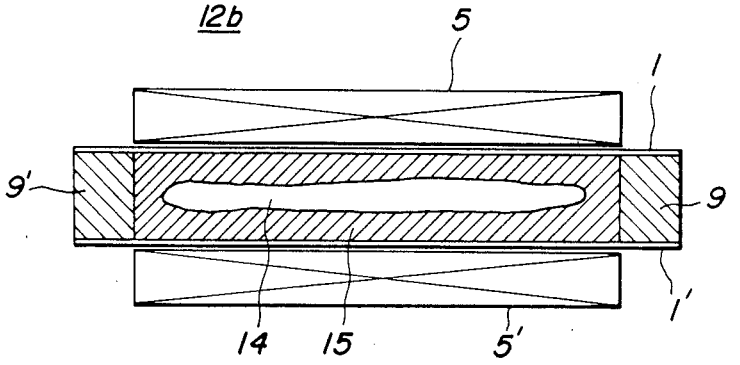
Figure 5:
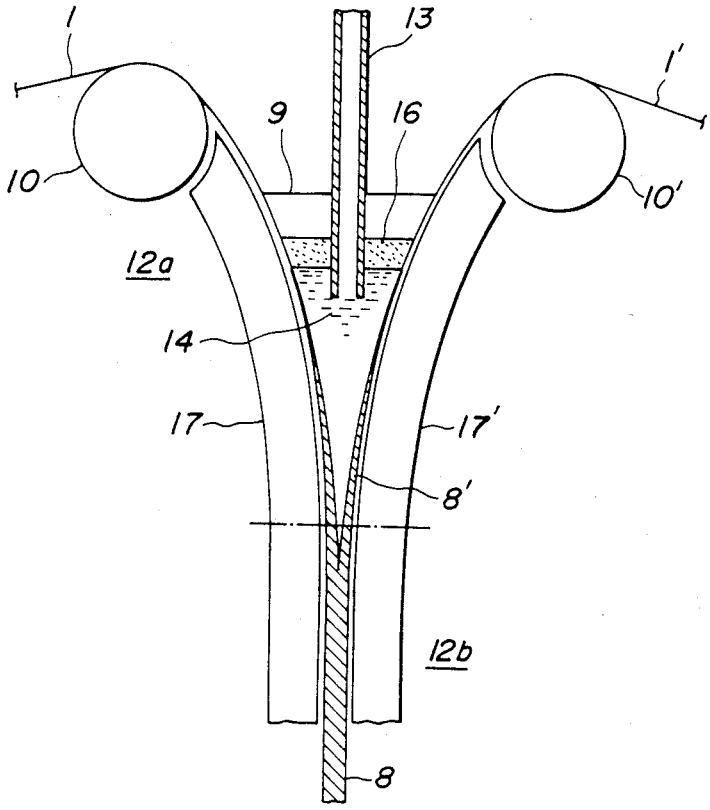
FIG. 5 is a schematically longitudinal section view in the molten metal converging portion of the continuous casting apparatus according to the invention.
Figure 6:
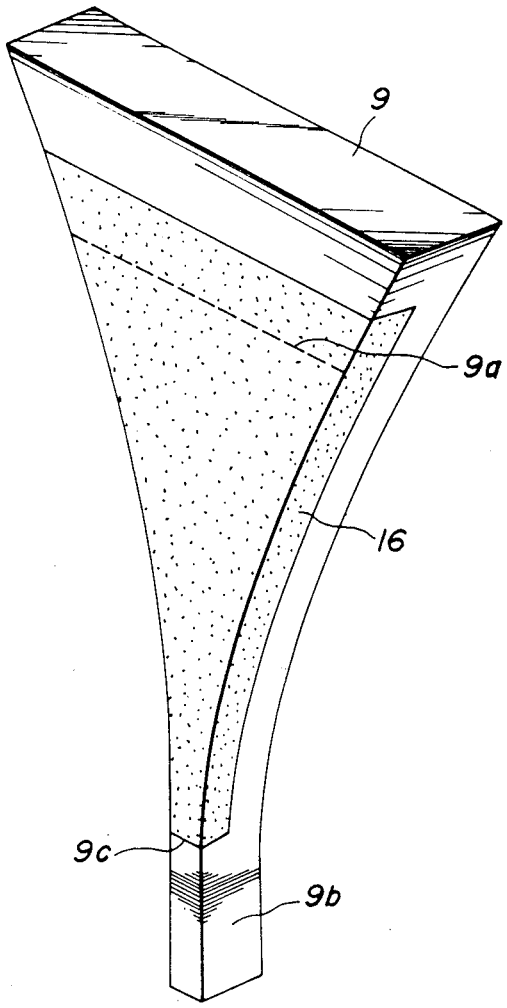
FIG. 6 is a perspective view of the tapered side plate for narrow-side plane.

In FIG. 5 is diagrammatically shown the molten steel converging portion of the continuous casting apparatus for the production of cast sheets according to the invention. As shown in the figure, the inner surface of the side plate 9 for narrow-side plane in a molten steel holding portion 12*a* of a downwardly tapered form is lined with a refractory layer 16 having a small thermal conductivity so as not to substantially grow the narrow-side solidification shell at this region of the molten steel holding portion 12*a*, whereby the converging rolls 11, 11' as shown in FIG. 2 are omitted. Further, the shape and size of the side plate are properly selected so as to give a predetermined convering action to a region extending from the tapered molten steel holding portion 12*a* to a molten steel solidifying portion 12*b* of constant thickness, while molten steel is supported through the metal belts 1, 1' by filmy cooling water flows of pressurized cooling waters jetted from metal pads 17, 17' each arranged behind the metal belt, whereby the converging action is applied to molten steel in the molten steel holding portion.

Figure 7:
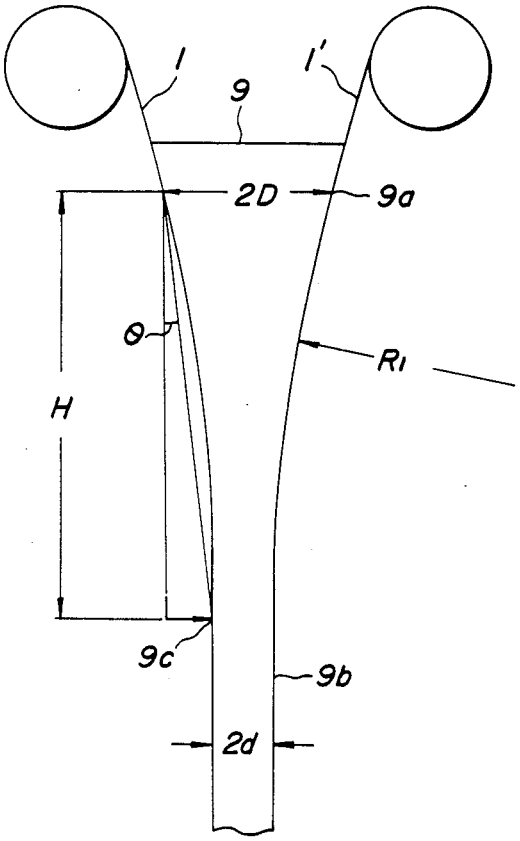
FIGS. 7 and 8 are explanatory views for the size of the tapered shape in the molten metal converging portion, respectively.
Figure 8:
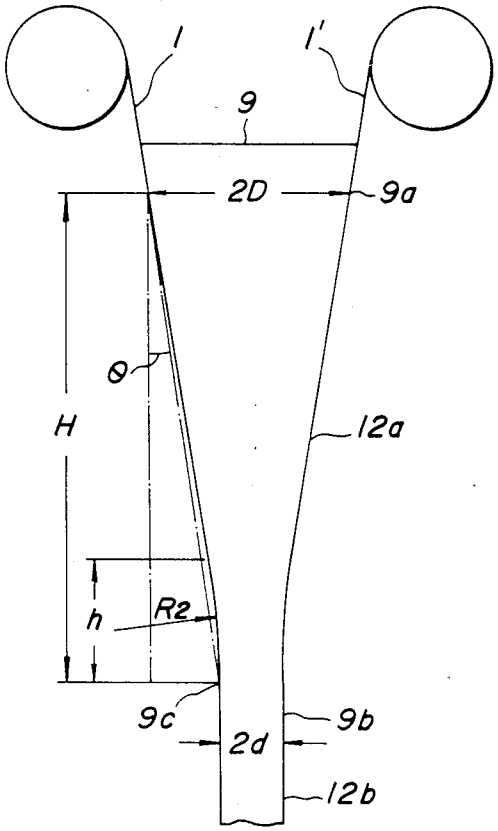

The converging angle $\theta$ of the tapered side plate or the reduction rate of the thickness of the molten steel holding portion 12*a* is required to be not less than 2% of natural solidification shrinkage of metal per 1 meter of length in vertical direction. In order to produce cast sheets economically and in large quantities, it is required to select the shape and size of the side plate 9 so that as shown in FIGS. 7 and 8, a width 2D at a molten steel level (meniscus) 9*a* of the side plate 9, a width 2*d* and a converging angle $\theta$ at lower end part of the side plate with constant width corresponding to the desired thickness of the cast sheet are within the following ranges:

$d = 5\text{–}30$ mm $D \geqq 60$ mm $D/d \leqq 16$ $\theta \leqq 30°$ $\theta = \tan^{-1}(D-d)/H$, wherein H represents a vertical distance from the molten steel level 9*a* to the upper end 9*c* of the portion 9*b* with constant width 2*d*. As to H, a value of not less than 300 mm is usually adopted and a value of not more than 1,000 mm is an upper limit. FIG. 7 shows such a case that the broad-side planes defined by the metal belts 1, 1' in the molten steel holding portion 12*a* are curved along a curve having a constant radius $R_1$, and FIG. 8 shows such a case that the broad-side plane is sloped along a straight line from the molten steel level of the thickness 2D to a vertical distance H-h and then curved along a curve having a constant radius $R_2$ at a vertical distance portion h.

If the thickness of the cast sheet (2*d*) is thinner than 10 mm, it is difficult to conduct a stable casting, particularly a pouring in the casting for sheet bar having a broad width. While, if the thickness exceeds 60 mm, it is possible to conduct the casting, but the number of roll stands for rolling after the casting becomes large and consequently merits based on the casting for the cast sheet are lost. That is, it is difficult to directly supply the cast sheet to a finish mill and also it is impossible to conduct the coiling of hot cast sheet.

If the thickness (2D) at the molten steel level is less than 120 mm, the pouring system suitable for mass production not only gets into troubles but also the cost of the pouring nozzle becomes high and the thickness of the pouring nozzle cannot sufficiently be maintained, so that the wear rate becomes earlier and a serviceable life decreases and consequently the production cost of cast sheets becomes higher.

If D/d exceeds 16 or $\theta$ exceeds 30°, the converging resistance increases and it is very difficult to draw the cast sheet. That is, the bending counterforce of the cast sheet increases to push the metal belts in the converging at the drawing time, so that it is difficult to form filmy water flow for the cooling of the metal belt to cause the seizing between the belt and the cast sheet.

The invention will be described with respect to a numerical example in the above construction below. Using the continuous casting apparatus for the production of cast sheet for thin steel plate having the molten steel converging portion as shown in FIG. 5, provided that the molten steel holding portion has a thickness at the molten steel level of $2D = 200$ mm, a thickness at the molten steel solidifying portion of $2d = 35$ mm, a height from the molten steel level of $H = 500$ mm and a width of 1,050 mm, a melt of low-carbon Al killed steel was poured through an immersion nozzle and cast at a casting rate of 15 m/min and the resulting cast sheet was wound into a coil. After the coil was introduced into a heat holding furnace to uniformize the temperature of the coil, it was immediately rolled to produce a thin steel plate of 0.8 mm in thickness. The quality of the resulting thin steel plate was good likewise the case of rough-rolling and finish-rolling the cast slab after the casting with the usual continuous casting apparatus. On the contrary, when the molten steel holding portions having a thickness at the molten steel level of 2D=200 mm, a thickness at the molten steel solidifying portion of 2*d*=5 mm, a height of H=500 mm and a width of 1,050 mm; 2D=400 mm, 2*d*=20 mm, H=500 mm and a width of 1,050 mm; and 2D=500 mm, 2*d*=30 mm, H=700 mm and a width of 1,050 mm were used as a comparative example, the accident of leaking molten steel was caused due to the breaking of the solidification shell and hence the continuous casting was difficult.

Figure 9:
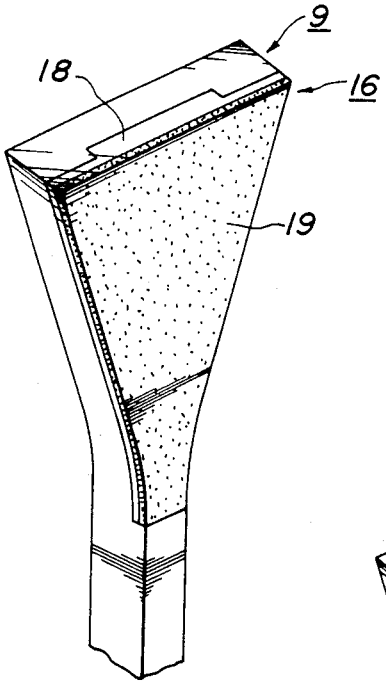
FIGS. 9–11 are perspective views of the other embodiments of the tapered side plates provided with a refractory lining, respectively.
Figure 10:
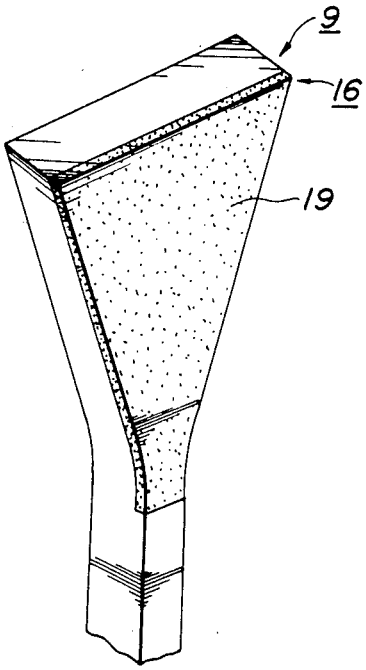

FIGS. 9 and 10 show the other embodiments of the invention. FIG. 9 shows an embodiment that a refractory layer 16 lined to the inner surface of the metal side plate 9 for narrow-side plane is composed of an alumina graphite plate 18 and a spray coating layer 19 of a refractory consisting mainly of zirconia ($ZrO_2$) and spray-coated on the surface thereof, and FIG. 10 shows an embodiment that the refractory layer is composed of only a spray coating layer 19 of a refractory consisting mainly of zirconia and directly spray-coated on the surface of the metal side plate 9.

When the refractory layer 16 is made by affixing or fitting the refractory plate to the metal side plate 9 as shown in FIG. 9, the refractory plate is required to be effective for preventing erosion of molten steel and slag and have a bond strength to the metal side plate and a spalling resistance. Accordingly, as the refractory plate having such properties, for instance, an alumina graphite containing carbon is preferable. However, since the carbon-containing refractory plate of this type generally have a high thermal conductivity, it is required that the thickness of the refractory is made as thick as 100–150 mm for preventing the growth of solidification shell. The refractory plate having such a thickness not only becomes larer in the weight and is difficult in the attaching and detaching, but also can perform no partial repair if cracks or erosion occurs during the use owing to the one-piece body and consequently it is necessary to replace the refractory plate itself with a new one. Further, the refractory plate of the aforementioned material has a lifetime of only two heats and the refractory cost increases. Therefore, when the aforementioned refractory plate made of alumina graphite is used to form the refractory layer 16, it is favorable to spray-coat a refractory such as zirconia onto the refractory plate to form a spray coating layer thereon.

Thus, if the spray coating layer is provided on the refractory plate of alumina graphite, for instance, when the thickness of the refractory plate is 25 mm, a spray coating zirconia layer with a thickness of 2.5 mm can be fit for the successive use of 6 heats as the refractory layer. Alternatively, when the spray coating is directly applied to the metal side plate 9, a spray coating zirconia layer with a thickness of 5 mm can be fit for the successive use of 4 heats as the refractory layer.

As mentioned above, the use of the spraycoating zirconia layer not only makes the thickness of the refractory layer 16 a reasonable thickness, but also permits to prolong the lifetime by partial spray coating repair if a part of the spray coating layer falls off, whereby the non-operating time caused by the exchange of the metal side plate can considerably be shortened in addition to the reduction of the refractory cost.

In addition, a CrC or WC series refractory having excellent thermal shock resistance, thermal seizing resistance, molten steel adhesion resistance and high temperature hardness may be spray-coated to the surface of the side plate. In this case, as the composition of CrC series refractory, a composition consisting by weight of $CrC_2$: 65–90% and NiCr: 35–10% is preferable. As the composition of WC series refractory, a composition consisting by weight of WC: 65–90% and CO: 35–10%, or WC: 65–90% and NiCr: 35–10% may be used.

Figure 11:
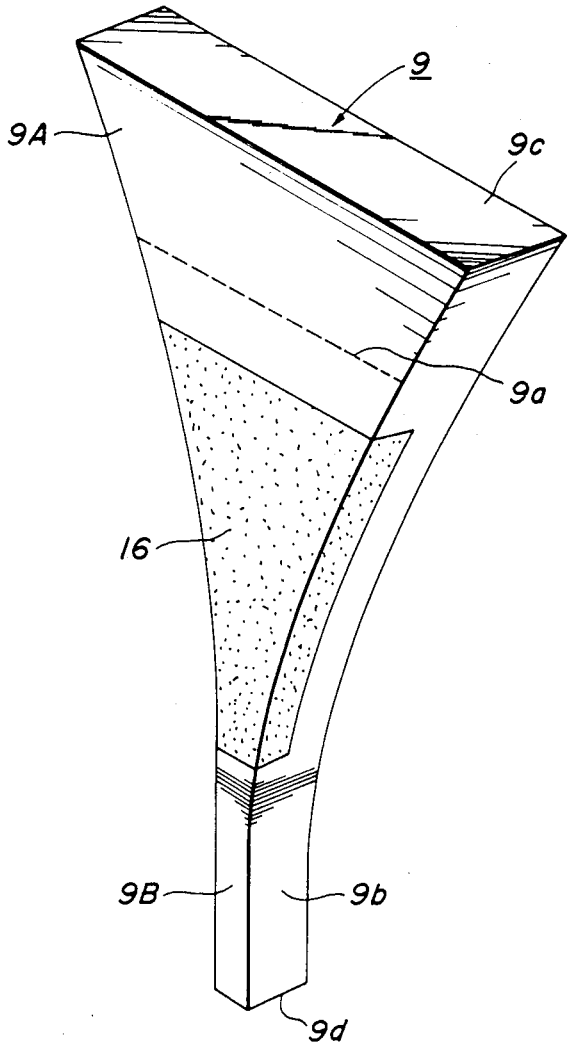

FIG. 11 shows another embodiment of the invention, wherein the sliding contact portion at molten steel level 9*a* in the tapered side plate 9 against the metal belt is composed of a quenching metal plate 9A. Since the upper portion of the metal plate 9A contacting with the molten steel is determined by considering the change of the molten steel level in the casting, it is arranged so as to downwardly extend to 100–200 mm, preferably about 150 mm from the molten steel level. The illustrated side plate 9 has, for example, such a tapered shape that the width at the upper end 9*c* is 300 mm, the width at the molten steel level 9*a* is 200 mm, the width at the lower parallel portion 9*b*, is 30 mm and the total length is 1,050 mm, wherein portions 9A, 9B of the side plate facing molten steel and extending to 400 mm from the upper end 9*c* and to 300 mm from the lower end 9*b* are composed of the quenching metal plate and the remaining middle portion of about 350 mm in length is composed of the refractory layer 16.

By using the side plate of the aforementioned construction, a substantially improved effect can be obtained, that is, it is possible to continuously cast a cast sheet of low-carbon A killed steel sheet having, for example, a width of 850 mm and a thickness of 30 mm at a drawing rate of 7.2 m/min for a long time such as about 2 hours, and the leakage accident of molten steel due to breaking of the solidification shell can substantially be prevented.

As shown in the embodiment of FIG. 11, when the sliding contact portion at molten steel level of the side plate against the metal belt is composed of the quenching metal plate 9A, molten steel is cooled to form a solidification shell by contacting with the quenching metal plate 9A. However, when the cast sheet of several tens mm in thickness is directly casted, the drawing rate is as very high as not less than 5 m/min, usually 7–30 m/min as compared with the case of continuously casting thick cast slab at the drawing rate of 1–2 m/min, so that the thickness of the solidification shell formed by the quenching metal shell 9A near the molten steel level is thin and the temperature thereof is high and consequently this solidification shell can very easily be deformed so as not to put the increase of the drawing resistance in question. Particularly, the solidification shell formed on the surface of the quenching metal plate 9A is separated out from the quenching metal plate 9*a* of the fixed side plate by the solidification shell formed on the surfaces of the metal belt because of the difference in velocity between the rotating metal belt 1, 1' and the fixed side plate 9, and as a result the drawing resistance is scarcely increased.

Then, the invention will be investigated with respect to the metal belt.

According to our investigations, it has been found that the reason why the metal belt used in the conventional apparatus has aforementioned drawbacks results from the fact that the belt has not a strength enough to be used under such a circumstance that one surface of the belt contacts with molten steel and the other surface contact with a cooling water, and the unsuitableness of the welding technique.

Figure 12:
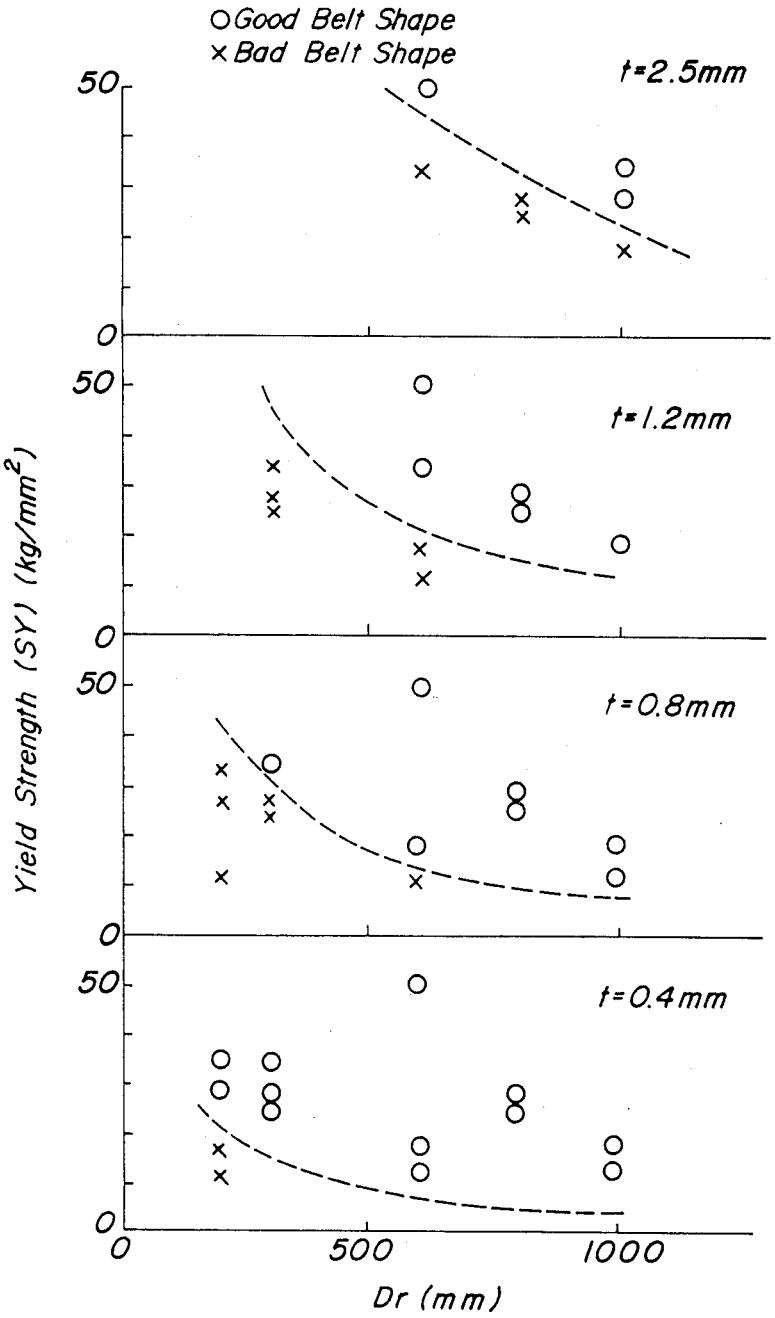
FIG. 12 is a graph showing a relation between the yield strength of the metal belt and the diameter (Dr) of the guide roll.

Considering the fact that the metal belts 1, 1', are subjected to bending deformation in the circulatedly moving around guide rolls 2, 2', 3, 3', and 4, 4' and particularly the smaller the roll diameters is and the larger the thickness of the belt is, the larger the strain due to the bending deformation is, the strength of the belt must be determined based upon a relationship between the diameter D of the guide roll and the thickess t of the belt. FIG. 12 shows a relationship between the yield strength Sy (kgf/mm$^2$) of the belt and the diameter Dr (mm) of the guide roll, after the presence or absence of belt deformation is examined by using belts of 0.4 mm–2.5 mm in thickness under a tension of 3.6 kg/mm$^2$. From this figure is introduced the following;

$$Sy \geqq 10{,}500\ t/Dr \qquad (1)$$

$0.4 \leqq t \leqq 2.5$ $t \leqq 0.4$; The belt is so thin that on catching foreign matters between the belt and the roll, holes are easily formed and consequently the leakage of water and the like tends to occur. Additionally, the breaking of the belt is apt to occur from the scratched portions.

$t \geqq 2.5$; As apparent from FIG. 12, rolls having a very large diameter are required in order to avoid the deformation of the belt, which loses merits of the belt type apparatus.

The above yield strength required for the metal belt may be achieved by controlling the cooling rate so as to obtain a martensite structure as in a low yield ratio, high strength cold-rolled steel; dual phase steel (CHLY). However, when the continuous casting is carried out by applying the metal belt of CHLY to the continuous casting apparatus according to the invention, the metal belt is repeatedly subjected to simultaneous action of heating and cooling in the casting, and consequently the strength of the metal belt considerably loweres.

In this point, as the preferred metal belt according to the invention, use may be made of a high strength steel of a solid-solution strengthening type using P, Si and Mn as a solid-solution strengthening element and having an yield strength of not less than 25 kgf/m$^2$. This material scarcely represents the reduction of yield strength even when being repeatedly subjected to the simultaneous action of heating and cooling. For instance, cold-rolled steel sheets for automobile (SPFC40–60), phosphorus containing high strength cold-rolled steel sheet (CHR40–60) and the like are steels showing substantially no reduction of yield strength, which can very conveniently be used as the metal belt for the continuous casting apparatus according to the invention (see Table 1).

Table 1 shows results when casting Al killed steel by means of the apparatus illustrated in FIG. 2 (roll diameter 400 mmϕ, thickness of cast sheet 95 mm. width of cast sheet 500 mm). In this case, the thickness of the belt was 0.8 mm.

TABLE 1

| | Kind of cast sheet | Yield strength Sy (kgf/mm$^2$) | Number of repeat uses until the replacement of the belt Note (1) | Index of belt shape under tension Note (1) | Remarks |
|---|---|---|---|---|---|
| Comparative Example I | SPCC-1 | 18 | 1.0 | 1.0 | |
| Example I | CHLY-60 | 34 | 0.7 | 2.0 | Shape is improved, but lifetime is short. |
| Example II | CHR-40 | 26 | 2.5 | 1.7 | Both shape and lifetime are improved. |
| Example III | APFC-40 | 28 | 1.8 | 1.8 | Both shape and lifetime are improved. |
| Example IV | APFC-60 | 50 | 2.8 | 2.5 | Both shape and lifetime are improved. |

Note (1)
The values were reqresented by an index on a basis that a value of Comparative Example I was 1.
The larger the index value, the higher the degree of improvement.

From the above, the yield strength of the belt is required to be not less than 20 kgf/mm$^2$, preferably not less than 25 kgf/mm$^2$ in order to improve the shape of the belt under tension (warp of C surface).

And also, clad steel sheet is effective as the metal belt having the yield strength corresponding to the roll diameter and the like as mentioned above.

Subsequently, the aforementioned materials were examined with respect to the weld zone formed by the welding for the formation of endless metal belts 1, 1'.

As a result, it has been found that the reverse bend testing described in JIS Z 3126 is very well matched when evaluating the occurrence of cracking from the weld zone and heat-affected zone in the actual operation or the lifetime of the metal belt.

Figure 13A:
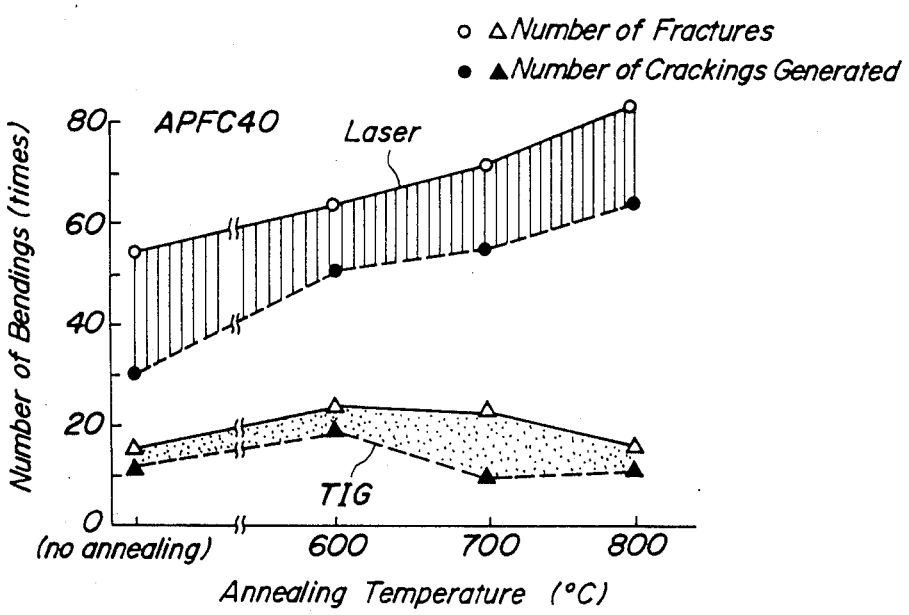
FIGS. 13(*a*) and (*b*) are graphs showing results of the welding test for the metal belt according to the invention, respectively.

Now, the above steel sheets for metal belt were examined with respect to various welding methods and welding conditions and subjected to the reverse bend testing and as a result, it has been found that a method of laser welding is very excellent as shown in FIGS. 13*a* and *b*.

APFC 40 of 0.7 mm in thickness and SPCE of 0.8 mm in thickness were welded by means of the butt TIG welding at a welding rate of 30 mm/min and a current of 60–70 A and the butt laser welding at a welding rate of 2.5 m/min and a power of 1.1 kw, and then specimens were obtained therefrom and subjected to the reverse bend testing while changing the annealing conditions for the removal of strain. The results thus obtained are shown in FIGS. 13*a* and *b*.

Figure 13B:
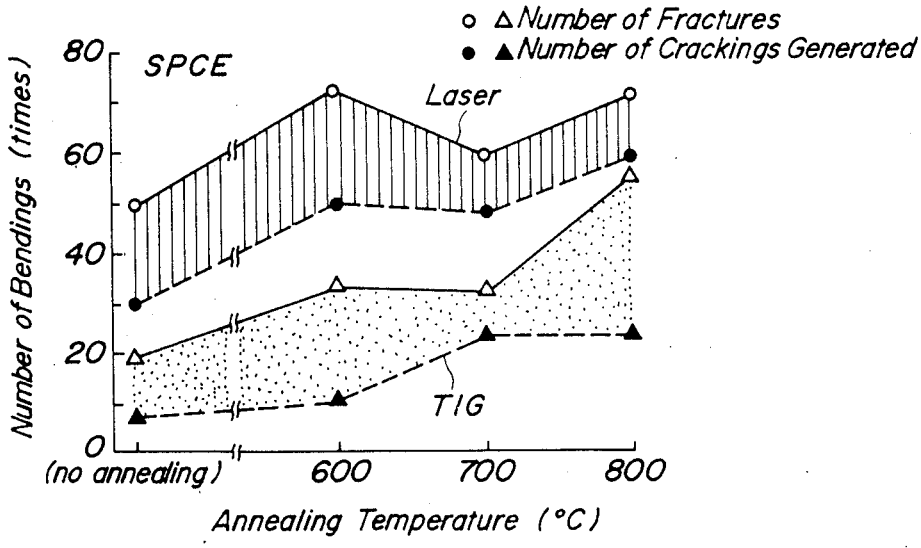

In the laser welding, not only the structure of the weld zone becomes homogeneous, but also the heat-affected zone can be restricted in a very narrow area as compared with the case of TIG welding, MIG welding, gas welding or the like, so that it is hard to generate cracks resulting from the degradation of these zones and the strength is 2–3 times that of TIG welding as shown in FIG. 13. That is, in case of the laser welding, a remarkably improved effect has been found.

Such an improved effect based on the laser welding was attained in not only APFC and SPCE, but also SPCC-1-4, SUS 304, SUS 430 or clad steel composed of SUS 304 and SS material.

Then, the invention will be described with respect to the following examples.

EXAMPLE 1

EMBODIMENT USING HIGH STRENGTH STEEL

A metal belt of APFC 60 containing components of C=0.10%, Si=1.10%, Mn=2.00%, P=0.015%, S=0.006%, Al=0.030% and Nb=0.030% and having an yield strength of 50 kgf/mm$^2$, a thickness of 1.2 mm and a width of 800 mm was used in the apparatus shown in FIG. 2 (roll diameter 600 mm), whereby a cast sheet having a thickness of 95 mm and a width of 500 mm (low-carbon Al killed steel) was continuously cast at a casting rate of 4.0 m/min.

As a result, the deformation of the metal belt was very small as compared with the case of the continuous casting using the conventional metal belt of SPCE material (yield strength 16 kgf/mm$^2$), and the shape of the resulting cast sheet and the surface properties of the thin plate after the rolling were good, respectively. Moreover, the lifetime of the metal belt increased by about 1.5 times as high as that of the conventional metal belt.

EXAMPLE 2

EMBODIMENT OF USING HIGH STRENGTH STEEL

A metal belt of CHR 40 containing components of C=0.06%, Si=0.01%, Mn=0.50%, P=0.090%, S=0.010% and Al=0.055% and having an yield strength of 26 kgf/mm$^2$, a thickness of 0.8 mm and a width of 800 mm was used in the apparatus shown in FIG. 2 (roll diameter 600 mm), whereby a cast sheet having a thickness of 95 mm and a width of 500 mm (low-carbon Al killed steel) was continuously cast at a casting rate of 3.7 mm/min.

As a result, the deformation of the metal belt was small as compared with the case of the continuous casting using the conventional metal belt of SPCE material (yield strength 16 kgf/mm$^2$), and also the shape of the resulting cast sheet was good.

EXAMPLE 3

EMBODIMENT OF USING CLAD STEEL

A clad steel composed of 18-18 -8 stainless steel facing molten metal and SS material for general structure facing the cooling water with a cladding ratio of about 1:1 and having an yield strength of 30 kgf/mm$^2$, a thickness of 0.8 mm and a width of 800 mm was used as a metal belt in the continuous casting apparatus shown in FIG. 2 (roll diameter 400 mm) to continuously cast a common steel (C=0.20% ) having a thickness of 130 mm and a width of 500 mm.

In the apparatus using the metal belt of SPCC material (yield strength 18 kgf/mm$^2$) having the same thickness, it was obliged to exchange the belt after the casting for about 2 hours due to the wavy deformation. On the other hand, when the above clad material according to the invention was used as the metal belt, the continuous casting could be performed for about 10 hours without troubling and the surface of the resulting cast sheet was clean. And also, scratches generated in the sliding contact portion against the fixed side plate were considerably reduced as compared with the conventional metal belt of SPCC material.

EXAMPLE 4

EMBODIMENT OF USING LASER WELDING

In the continuous casting apparatus as shown in FIG. 2 (roll diameter: 600 mm) using a pair of metal belts each formed by welding both ends of APFC 40 materials having an yield strength of 28 kgf/mm$^2$, a thickness of 0.8 mm and a width of 1,350 mm to each other by means of a laser welding machine, low-carbon Al killed steel was continuously cast into a sheet having a thickness of 80 mm and a width of 1,000 mm. As a result, when using the laser welded metal belt, the lifetime was confirmed to be about 1.5-2 times that of the conventional metal belt formed by TIG welding. Further, the bad shape of the cast sheet, which had frequently been observed using the TIG welded metal belt, was considerably reduced.

EXAMPLE

EMBODIMENT OF USING LASER WELDING

In the continuous casting apparatus of a rotary caster system (roll diameter 600 mm) using a metal belt formed by welding both ends of SPCC material having an yield strength of 18 kgf/mm$^2$, a thickness of 1.6 mm and a width of 300 mm to each other by means of laser welding machine, and a casting wheel of 3 mm in diameter, a billet (C=0.2%, Mn=0.85%) having a cross section of 130×150 mm$^2$ was continuously cast at a drawing rate of 3.5 m/min. In this case, the a temperature of the tundish was maintained at 1,535±5° C. When using the TIG welded metal belt made of the same material, cracks were produced from the weld zone or heat-affected zone, so that it was required to perform the exchange of the metal belt after the casting of about 3,000 tons. On the contrary, the laser welded metal belt showed no occurrence of cracks even after the casting of about 6,000 ton and was good.

Next, the invention will be described in detail with respect to means for applying a lubricant in order to prevent the oxidation of the metal belt and increase the lubrication effect to thereby improve the lifetime of the belt and provide a cast sheet having good surface properties.

According to the invention, prior to the beginning of the casting or the heating of the narrowside wall, an antioxidant such as an organic resin, BN powder or the like is first applied to the inner surfaces of the metal belts 1, 1' in contact with molten steel. When applying such an antioxidant, the oxidation of the metal belts was scarcely observed and no red-rust occurred red.

In the casting, at least prior to the contacting with molten steel, a lubricant selected from rapeseed oil, an organic resin, an inorganic antioxidant such as BN or the like and a mixture thereof is applied to the inner surfaces of the metal belts 1, 1' to form a coating thereon, and the casting is continued. In this way, when using the coating of the lubricant or the antioxidative lubricant, the weld between the cast sheet 8 and the metal belts 1, 1', or seizing is completely prevented by the lubrication effect.

Moreover, the method of coating the metal belt with the above antioxidant and lubricant is not particularly to the application, spraying and the like.

The used coating material preferably has both antioxidation and lubrication and includes, for example, (1) Teflon, rapeseed oil or heavy oil as an organic material; and (2) BN, zircon powder or zirconia powder as an inorganic material.

The coated amount is 50 g/m$^2$–500 g/m$^2$. When it is less than 50 g/m$^2$, seizing partially occurs, while when it exceeds 500 g/m$^2$, solidification of the cast sheet becomes slow because heat conductivity becomes poor.

In this connection, the explanation will be made with respect to the following example.

Molten steel (C/0.04%, Si/0.2%. Mn/0.3%, P/0.02%, S/0.015%, Al/0.04%) of 5 ton per heat was poured into the belt converting type continuous casting apparatus as shown in FIG. 2 to form a cast sheet having a thickness of 30 mm, a width of 1,000 mm and a length of 23 mm. In this case, each of rapeseed oil, Teflon, BN and BN+ rapeseed oil was applied to that surface of the steel belt which holds molten steel and then the lifetime of the steel belt and the number of seizing times between the cast sheet and the steel belt were examined as index.

Prior to the casting, the coating material consisting of a mixture of BN and rapeseed oil was applied to the belts contacting with molten steel by means of a brush. The coated amount was 70 g per m$^2$ of the belt.

Rapeseed oil was sprayed in an amount of 50 g/m$^2$ onto the above coated area by means of a spraying system after the beginning of the casting.

The lifetime of the belts and the number of seizing times every each coating material are shown together with the comparative case of no application in Table 1. According to the invention, the lifetime of the belt was prolonged, thermal strain and oxidation were effectively prevented and the number of seizing times was reduced.

TABLE 1

| | Comparative belt No application | Metal belt according to the invention | | | |
|---|---|---|---|---|---|
| | | Application of rapeseed oil | Application of Teflon | Application of BN | Application of BN + rapeseed oil |
| Lifetime of belt | 2 heats | 6 heats | 6 heats | 10 heats | 10 heats |
| Number of seizing times | 0.8 times/heat | 0.1 times/heat | 0.2 times/heat | 0 times/heat | 0.1 times/heat |

INDUSTRIAL APPLICABILITY

As mentioned above, the belt converging type continuous casting apparatus according to the invention is applicable not only to directly produce thin steel plate such as sheet bar from molten steel, but also to a technique for the continuous casting of aluminum. alloy thereof and the like.

We claim:

1. In a belt converging type continuous casting apparatus for the production of cast sheets comprising a combination of a pair of metal belts for supporting broad-side planes of the cast sheet arranged opposite to each other with circulatedly moving, and a pair of tapered fixed-type side plates for supporting narrow-side planes of the cast sheet each disposed between the metal belts in intimate contact therewith, the improvement wherein said side plate has such a shape that a width 2D at molten metal level of the side plate, a width 2*d* and a converging angle $\theta$ at lower portion corresponding to the cast sheet thickness of the same side plate satisfy the following requirements:

$d = 5\text{–}30$ mm $D \geqq 60$ mm $D/d \leqq 16$ $\theta \leqq 30°[\theta = \tan^{-1}(D-d)/H$ (wherein, H is a vertical distance from the molten metal level to the upper end of the portion of constant width 2d)]; and said metal belt is used to have an yield strength Sy satisfying the following relations to a thickness t of the belt and a diameter Dr of a guide roll:

$Sy \geqq 10{,}500\ t/Dr$ $0.4 \leqq t \leqq 2.5$, wherein

Sy: yield strength (kgf/mm$^2$)

Dr: diameter of the guide roll (mm)

t : thickness of the belt (mm).

2. The continuous casting apparatus according to claim 1, wherein that portion of said side plate which contacts with molten steel is composed of a metal plate, and the surface of the metal plate is provided with a spray coating layer of a refractory having an erosion resistance and a low heat conductivity.

3. The continuous casting apparatus according to claim 1, wherein that portion of said side plate which contacts with molten metal is composed of a metal plate, and the surface of the metal plate is spraycoated with a CrC series or WC series refractory having excellent thermal shock resistance, thermal seizing resistance, molten steel adhesion resistance and high-temperature hardness.

4. The continuous casting apparatus according to claim 1 wherein an upper end of the refractory arranged on that surface portion of said side plate which contacts with molten metal is located beneath a molten metal level of molten metal, and a quenching metal plate is arranged on the molten metal level portion.

5. The continuous casting apparatus according to claim 1, wherein said metal belt is a high strength cold-rolled steel of a solid-solution strengthening type using P, Si and Mn as a solid-solution strengthening element.

6. The continuous casting apparatus according to claim 1, wherein said metal belt is a clad steel composed of stainless steel at the side in contact with molten metal and steel for general structure at the cooling side.

7. The continuous casting apparatus according to claim 1, wherein said metal belt is one obtained by endlessly joining it through a laser welding.

8. The continuous casting apparatus according to claim 5, wherein prior to the casting, that surface of said metal belt which contacts with molten metal is coated with a lubricant having an antioxidation function.

9. The continuous casting apparatus according to claim 5, wherein said metal belt is one obtained by endlessly joining it through a laser welding.

10. The continuous casting apparatus according to claim 6, wherein said metal belt is one obtained by endlessly joining it through a laser welding.

11. The continuous casting appratus according to claim 5, wherein prior to the casting, that surface of said metal belt which contacts with molten metal is coated with a lubricant having an antioxidation function.

12. The continuous casting apparatus according to claim 1, wherein that portion of said side plate which contacts with molten metal is composed of a refractory.

* * * * *